United States Patent [19]

Rylewski

[11] 4,061,449

[45] Dec. 6, 1977

[54] FLUID ROTATING MACHINES WITH SPIRAL-LIKE PASSAGES AND VANE WHEELS

[76] Inventor: Eugeniusz M. Rylewski, 43 bis, Avenue du Gal Leclerc, 78470 St. Remy les Chevreuse, France

[21] Appl. No.: 639,629

[22] Filed: Dec. 10, 1975

[30] Foreign Application Priority Data

Dec. 12, 1974 France ..... 74.40998

[51] Int. Cl.[2] ..... F01C 1/00; F03C 3/00; F04C 1/00

[52] U.S. Cl. ..... 418/226

[58] Field of Search ..... 418/215, 218, 226

[56] References Cited

U.S. PATENT DOCUMENTS

| | | | |
|---|---|---|---|
| 926,731 | 7/1909 | Dowling | 418/218 |
| 1,304,497 | 5/1919 | Maxam | 418/226 |
| 1,367,801 | 2/1921 | Clark | 418/226 |

*Primary Examiner*—John J. Vrablik
*Attorney, Agent, or Firm*—Morgan, Finnegan, Pine, Foley & Lee

[57] ABSTRACT

A rotative machine for fluids, comprising a disc with spiral-like passages disposed uniformly around an axis which is the axis of relative rotation of the said disc in relation to the machine part housing the vane wheels, the said vane wheels being housed in longitudinal slots of the machine part housing them. The passages are bound by the ribs formed on the disc, the edges of the ribs cooperating slidingly with a cooperating surface of the machine part housing the vane wheels so as to form conduits for the circulation of the fluid.

The edges of the ribs and also the cooperating surface of the machine part housing the vane wheels are in a plane and for the portion of the passage constituting a conduit extending between two extreme portions having only one rib, the volume rates of fluid at the extremities of the said portion are substantially the same.

2 Claims, 8 Drawing Figures

FLUID ROTATING MACHINES WITH SPIRAL-LIKE PASSAGES AND VANE WHEELS

The object of the invention is a fluid rotative machine with spiral-like passages and vane wheels.

The invention concerns fluid rotative machines comprising a stator and a rotor with, on the one hand, spiral-like passages disposed on a disc and on the other hand, vane wheels whose vanes circulate in the passages, from one end to the other. Such machines are described in the Patents listed below and which were filed in the name of the present applicant:

French Pat. no. 71 20194 of June 3, 1971 for "Driving or driven machine for liquids";

French Pat. no. 71 20195 of June 3, 1971 for "Driving or driven machine for gases";

French Pat. no. 71 20196 of June 3, 1971 for "Gas Turbine."

In those machines, the vanes of the vane wheels, while circulating in the passages, exert an action on the fluid or are exposed to an action from the fluid, according to whether the liquid or gas machine is a pump (or compressor) or a motor.

In all cases, the good operation of the machine imposes some laws of variation of the cross-section along the passage. In particular, it is imperative for a machine for liquids, that the volume-rate of flow in the portion of a passage comprised between two vanes circulating in it, should be constant, if water-hammer is to be avoided.

To comply with these laws, it was proposed to vary along the passages their dimension parallel to the axis of rotation, by varying along their length the height of the ribs which belong to the disc and which define the passages. The changing height of the said ribs, however, presents a problem of manufacturing, especially if, in order to ensure the proper sealing of the channels in which the fluid circulates and which are limited by the said passages, the top surfaces or portions of the ribs cooperate slidingly with a conjugated surface of revolution present on the part housing the vane wheels.

The present invention proceeds from the concept that, for a good operation of the machine, the condition relative to the volume of the cavity for the fluid in a passage, also when the fluid is incompressible, is imperative only when two vanes move with the liquid of the compartment which they border, circulate simultaneously in the passage;

Then, the present invention proposes a configuration of the portions or top surfaces of the ribs bordering the passages which, while complying with the conditions imposed by the laws resulting from the nature of the fluids circulating in the machine, in particular resulting from the quasi-incompressibility of liquids, depart from that condition when it is not indispensable.

The present invention makes use of the fact that a machine with spiral-like passages angularly uniformly distributed about the axis, have, to bound a passage, ribs whose extremities at the inlet and at the outlet are angularly off-set in relation to the axis, so that a vane being a part of a vane wheel situated in a diametral or a quasi-diametral plane and cooperating with the inlet portion of a passage does not cooperate immediately with the inlet portion of the other rib which borders the same passage. Consequently, during that phase, although the vane makes a mechanical link between the disc with the passages and the machine part housing the vane wheels, it does not have any operative action in the circulation of the fluid as long as it does not also cooperate with the other rib. The case is identical for a vane escaping from one rib while it continues to cooperate with the extreme portion of the other rib.

Thus, the present invention is distinguished by the fact that only those portions of the ribs which correspond to the operative extremities of the passage, that is to say, those for which a vane effectively cooperates with one and the other ribs bounding the passage, have a configuration which, in the case of a machine for liquids, comply with the quasi-incompressibility of the latter.

A great freedom in the configuration of the ribs is thus possible, particularly of their edges and also, consequently, of the conjugated surface of said ribs which belong to the machine part housing the vane wheels, while complying with the general conditions for the good operation of the machine.

A rotative machine with spiral-like passages and vane wheels according to the invention has the edges of its ribs situated in a plane, and the cooperating surface of the machine part housing the vane wheels is also a plane.

According to an alternative embodiment of the invention, said plane is perpendicular to the axis of rotation of the machine part housing the vane wheels in relation to the disc.

Consequently, the manufacture of a disc with spiral-like passages, as well as of the machine part housing the vane wheels, is considerably easier.

In the following description, made as an example, reference is made to the accompanying drawing, in which.

Figure 1:
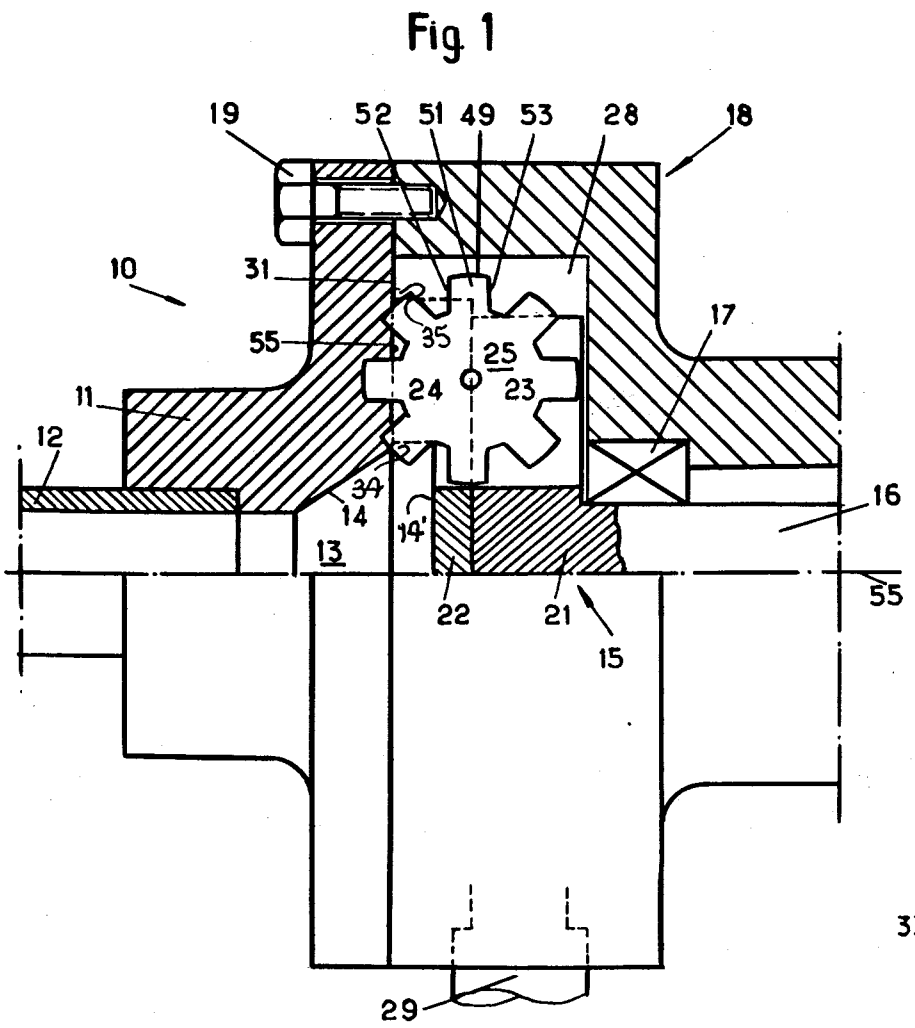
FIG. 1 is a schematic view of a machine, partly in elevation and partly in axial section.

In an embodiment of the invention adapted to a machine for liquids, for instance a pump, a disc 10 (FIG. 1) includes a core 11 to which is secured a pipe 12 in communication with a reserve of a liquid. The pipe 12 emerges into a central chamber 13 limited by the internal, flared out surface 14 of the bore 11 and also by the front face 14' of the part 15 housing the vane wheels. The latter is carried by the shaft 16, coaxial to the disc with the core 10–11 and which is mounted for rotation in a bearing 17 mounted in a casing 18 secured to the disc 10 by the screws 19.

Figure 2:
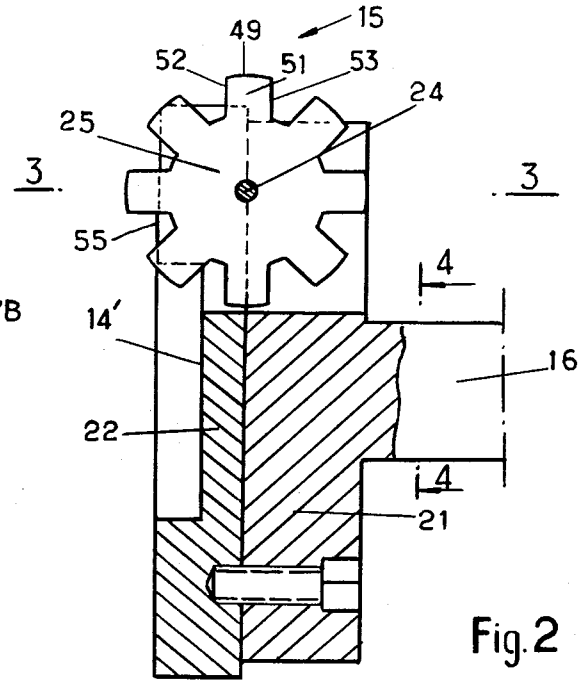
FIG. 2 is a view of a machine part housing the vane wheels, in section along line 2—2 of FIG. 4.
Figure 3:
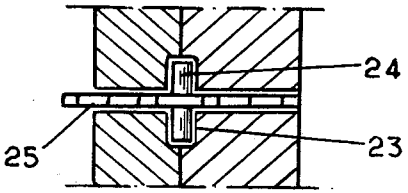
FIG. 3 is a view in section along line 3—3 of FIG. 2.
Figure 4:
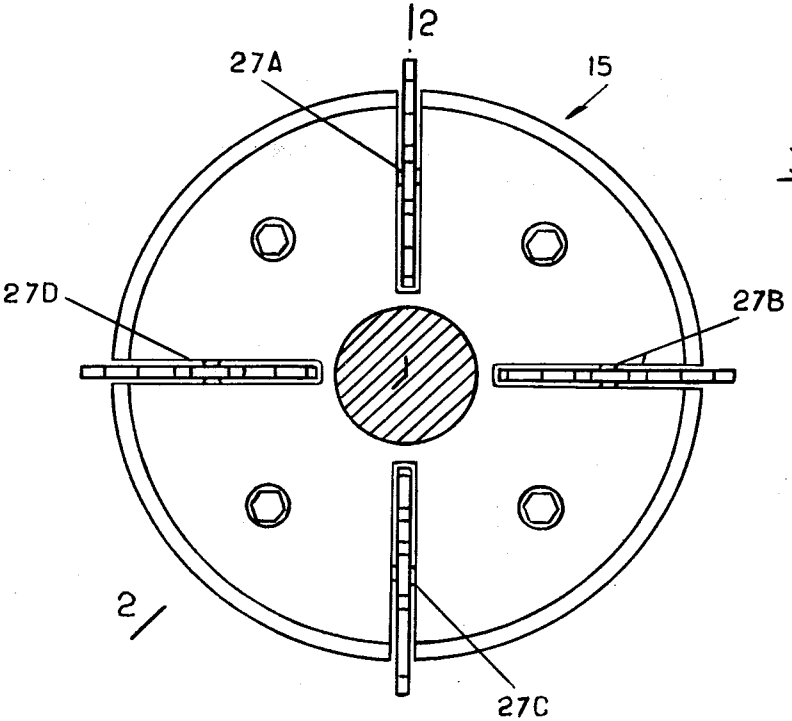
FIG. 4 is a view in section along line 4—4 of FIG. 2.

In the space provided between the casing 18 and the disc 10 is housed the peripheral portion of the part 15 which has a body 21 (FIG. 2) covered by a disc 22. The body 21 and the disc 22 comprise cavities 23 (FIG. 3) receiving the axles 24 of the vane wheels 25. The latter are housed in diametral slots 27A, 27B, 27C, 27D (FIG. 4) made as well in the body 21 as in the disc 22 and whose mean planes are perpendicular to one another. An annular chamber 28 is housed by the casing 18.

From this chamber originates a piping 29 which constitutes the outlet of the pump.

Figure 5:
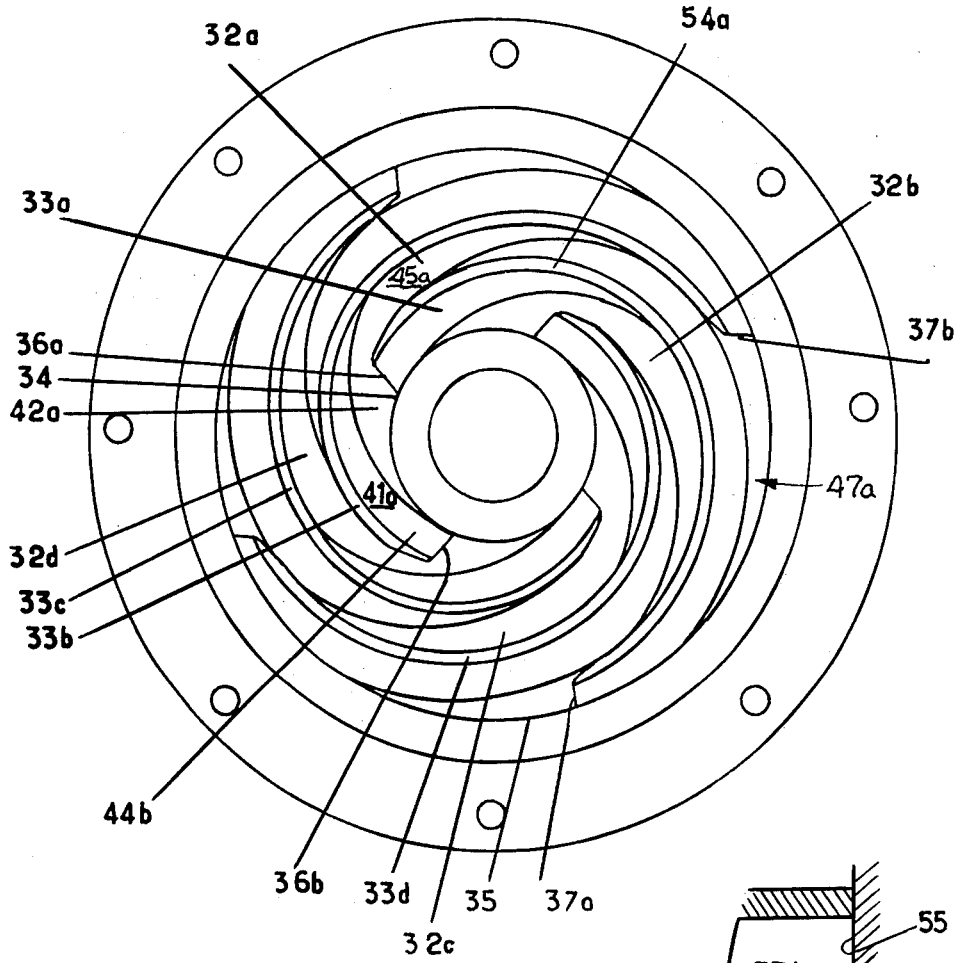
FIG. 5 is a front view of a disc with spiral-like passages.

On the face 31 of the disc 11 facing the casing 18 there are spiral-like passages, four in number in this embodiment: 32*a*, 32*b*, 32*c* and 32*d* (FIG. 5). The passage 32*a* is bordered, towards the inside, by spiral-like rib 33*a* and towards the outside, by the spiral-like rib 33*b*. The passage 32*d* is bordered, towards the inside, by the rib 33*b* and, towards the outside by the spiral-like rib 33*c*. The passage 32*c* is bordered, towards the inside, by the rib 33*c*, and, towards the outside, by the rib 33*d*. The passage 32*c* is bordered, towards the inside, by the rib 33*d* and, towards the outside, by the rib 33*a*.

Each rib has its interior or central origins on the circle 34 which constitute the extremity of the flared out surface 14 and it has its exterior or peripheral extremity on the exterior or peripheral circle 35 adjacent to the annular chamber 28. It extends, therefore, between a central edge 36 and a peripheral edge 37.

Figure 6:
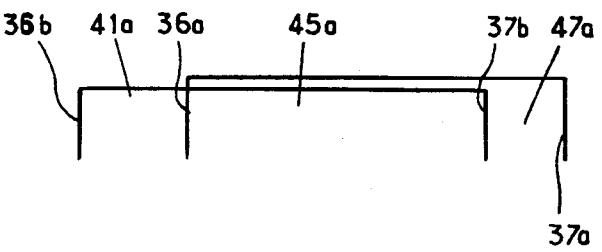
FIG. 6 is a simplified schematic view of two developed ribs.

FIG. 6 schematically shows, by a development of its exterior and interior ribs, that a passage 32, for example the passage 32*a*, has, therefore, a first portion 41*a* extending between the edge 36*b* of the exterior rib 33*b* and the edge 36*a* of the interior rib 33*a* in which it does not constitute a channel, as it only has, in addition to the bottom 42*a* (FIG. 7), one side-wall only, that is, the internal face 44*b* of the rib 33*b*, which is the external rib for the passage 32*a*.

Figure 7:
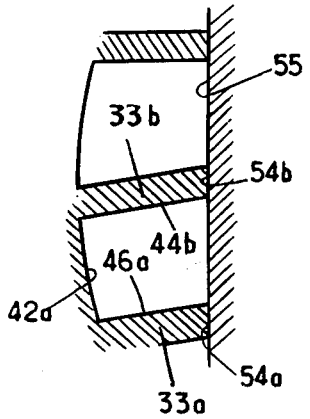
FIG. 7 is a schematic view in cross-section of a part of the disc with spiral-like passages with the cooperating portion of the machine part housing the vane wheels.

It comprises a second portion 45*a* extending between the edge 36*a* of the rib 33*a* and the peripheral edge or outlet edge 37*b* of the rib 33*b*. In that second portion, the passage is effectively a channel for the circulation of the fluid, its bottom 42*a* being flanked by an external side-wall constituted by the internal surface 44*b* of the rib 33*b* and by the internal side-wall constituted by the external face 46*a* of the rib 33*a* (FIG. 7).

The passage 32*a* has a third portion 47*a* between the edge 37*b* of the rib 33*b* and the edge 37*a* of the rib 33*a*. In that third portion, and as in the first portion, the passage 32*a* does not constitute a channel as such, missing, this time, at this peripheral extremity, not the internal side-wall but the external side-wall.

The bottoms 42 of the passages are on the surfaces defined by the frontal edges 49 of the vanes 51 of the wheels 25. The internal flanks 44 of the ribs 33 are defined by the lateral edges 52 of vanes 51 and the external flanks 46 are defined by the opposite lateral edges 53 of the vanes 51.

The portions 54 of the ribs 33 are in a plane perpendicular to the axis of rotation of the shaft 16 and the part 15 housing vane wheels has a flat bearing surface 55 ready to cooperate slidingly with the portions 54, thus completing the closed channels for the circulation of the fluid in portions 45 of the passages 32.

The diagram A (FIG. 8) is representative of the depth of a passage, for instance of the passage 32*a* from its inlet 36*a* up to its outlet 37*a*. The diagram B is representative of the linear velocity of advancement of a vane in the passage in relation to its position along the said passage. The volume of liquid discharged through a passage that would be bordered, along all its length, by an internal flank and by an external flank having the configuration of the ribs 33 is represented by the diagram C. It is equal to the product of the depth and the linear velocity. The diagram C is, by the nature of diagrams A and B, a diagram having an ascending portion and a descending portion. Consequently, there are pairs of points, like those marked $c_1$ and $c_2$, which have the same ordinates, that is to say, for which the volume rates are equal.

Figure 8:
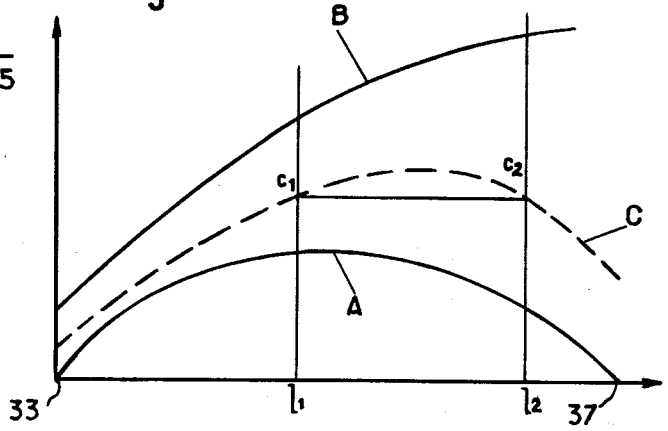
FIG. 8 shows the diagrams.

The present invention provides for a machine in which the extremities of the portions 45 of the passages, schematically shown on FIG. 6 in 36*a* and 37*b* for the passage 32*a*, are disposed along the passage in a pair of abscissa as $l_1$ and $l_2$ shown on the diagram of FIG. 8. Moreover, the passages and the vane wheels are arranged in such a way that, during its advancement in a passage, for example in the passage 32*a*, a vane of a wheel is practically facing the outlet extremity 37*b* of the external rib 33*d*, a vane of another wheel is practically facing the inlet extremity 36*a* of the internal rib 33*a*.

When a vane, at the downstream end of the channel, approaches the third portion 47*a* of the passage 32*a*, the latter already contains at the opposite end of its operating portion 45*a* another vane which prevents any direct communication through the passage 32*a* between the discharge and the inlet of the pump. However, during the short moment when the two vanes are simultaneously present in the portion 45*a* of the passage, no definite phenomenon of water-hammer or cavitation occurs because of the constancy at this moment of the volume of the channel for circulation for fluids between the two vanes 51.

Furthermore, it is not necessary to respect, with a precision which would be difficult to obtain, the equality of the volumes discharged by the vanes at the ends 36*a* and 37*b* of the operative portion 45*a* of the passage.

In the described embodiment, the plane comprising the edges of the ribs as well as the conjugated surface of the machine part housing the vane wheels are perpendicular to the axis of rotation of the machine part housing the vane wheels in relation to the disc with the passages. However, the invention also provides for an alternative embodiment according to which this plane is not perpendicular to the said axis.

What is claimed is:

1. In a positive-displacement rotative machine in which the conversion of the pressure energy of fluids is obtained by the circulation of at least two spaced vane members in at least one spiral-like passage of revolution defined by rib members having top surfaces and side walls, wherein said vane members are parts of at least two vane wheels, each of said vane wheels is mounted for rotation about its own axis and housed in a slot formed in a first part of said machine, said vane members circulate in said spiral-like passages of revolution formed in a second part of said machine, at least one of said first and second parts of said machine is rotatable, the axis of rotation thereof constituting the main axis of rotation of said machine, the axes of rotation of each of said vane wheels are transverse to said main axis of rotation of said machine, said spiral-like passages of revolution are generated by a combined rotation of said vane members about the axis of rotation of their respective vane wheels and by rotation of said first part of said machine in relation to said second part of said machine, said spiral-like passages are bound along their intermediate portions by a pair of said rib members while each end extremity portion thereof is bound by a single rib member, said intermediate portions of said spiral-like passages are closed across the top surfaces of said rib members by a cooperating surface formed on said first part of said machine receiving said vane wheels in sliding contact therewith to thereby form channels for the circulating fluid, and said spiral-like passages extend between an inlet and an outlet for the circulating fluid and have a continuous progressively varying cross-sectional area from the inlet to the outlet thereof, the improvement therein which comprises:

said top surfaces of said rib members and said cooperating surface formed on said first part of said machine in sliding contact therewith each lie in a single plane, the volume rates of flow at each of said end extremity portions of said spiral-like passages are substantially the same, and said vane wheels are spaced apart a distance such that two successive vane members circulating in said spiral-like passages simultaneously circulate in said intermediate portions thereof for only a short moment, whereby the volume rate of flow between two successive vane members circulating in said spiral-like passages is essentially contant.

2. A machine as claimed in claim 1, wherein said plane containing said top surfaces of said rib members and said cooperating surface formed on said first part of said machine is perpendicular to said main axis of rotation of said machine.

* * * * *